US005855676A

United States Patent [19]

Lu et al.

[11] Patent Number: 5,855,676

[45] Date of Patent: Jan. 5, 1999

[54] TUBE LINING APPARATUS

[75] Inventors: Guo-Quan Lu; Jesus N. Calata, both of Blacksburg, Va.

[73] Assignee: Virginia Tech Intellectual Properties, Inc., Blacksburg, Va.

[21] Appl. No.: 848,757

[22] Filed: May 1, 1997

[51] Int. Cl.[6] ..... B05B 13/06

[52] U.S. Cl. ..... 118/317; 118/58; 118/63; 118/105; 118/214; 118/305; 118/306; 118/407; 118/408; 118/410; 118/421; 118/600; 118/DIG. 10; 118/DIG. 13

[58] Field of Search ..... 118/58, 63, 105, 118/214, 305, 206, 317, 407, 408, 410, 421, 600, DIG. 10, DIG. 13; 427/236, 239; 239/DIG. 13

[56] References Cited

U.S. PATENT DOCUMENTS

| | | | |
|---|---|---|---|
| 2,444,572 | 7/1948 | Leet et al. | 118/317 |
| 3,055,339 | 9/1962 | Pistole et al. | 118/408 |
| 3,058,137 | 10/1962 | Doyle et al. | 118/DIG. 10 |
| 3,106,735 | 10/1963 | Landrum et al. | 118/306 |
| 3,111,431 | 11/1963 | Weaver | 118/DIG. 10 |
| 3,404,608 | 10/1968 | Allen | 118/408 |
| 3,960,644 | 6/1976 | McFadden | 118/306 |
| 3,966,389 | 6/1976 | Shubert | 425/460 |
| 4,329,937 | 5/1982 | Holland | 118/105 |
| 4,554,178 | 11/1985 | Yamamoto et al. | 427/140 |
| 4,745,879 | 5/1988 | Shishkin et al. | 118/105 |
| 4,774,905 | 10/1988 | Nobis | 118/304 |
| 5,019,417 | 5/1991 | Northcutt | 427/54.1 |
| 5,230,842 | 7/1993 | Munde | 427/239 |
| 5,309,947 | 5/1994 | Hinger | 118/306 |
| 5,326,400 | 7/1994 | Sagawa | 118/105 |
| 5,443,377 | 8/1995 | Perkins et al. | 428/11 |
| 5,499,659 | 3/1996 | Naf | 138/97 |

FOREIGN PATENT DOCUMENTS

| | | | |
|---|---|---|---|
| 844437 | 7/1939 | France | 118/DIG. 10 |
| 2922980 | 12/1979 | Germany | 118/306 |
| 46-28677 | 8/1971 | Japan | 427/239 |
| 136104 | 1/1960 | U.S.S.R. | 118/317 |
| 785379 | 12/1980 | U.S.S.R. | 118/408 |

*Primary Examiner*—Peter Chin
*Assistant Examiner*—Michael P. Colaianni
*Attorney, Agent, or Firm*—Whitham, Curtis & Whitham

[57] ABSTRACT

Tubelining device and technique using a coating-applicator for slip-casting a fluent liner coating onto the internal surface of a tube.

6 Claims, 2 Drawing Sheets

TUBE LINING APPARATUS

BACKGROUND OF THE INVENTION

1. Field of the Invention

The invention is generally related to lining an internal surface of a tube.

2. Description of the Prior Art

Tubes are widely used in industrial, municipal, and domestic applications as means to transport flowable materials between different locations. In many industrial applications, the tubes are used to transport chemicals under severe conditions, such as corrosive, high temperature, high pressure, and combinations of these conditions. Two primary concerns in these applications are wear and/or corrosion damage to the internal walls of tubes. Wear is a problem for tubes in general while both wear and corrosion problems can be a concern in the case of metal tubes. Every year the cost of wear and/or corrosion damage to tubes is in the many millions of dollars in terms of production down-time and tube repair or replacement work.

To address the corrosion and wear problems associated with metal tubes, for instance, the tube ideally would be formed as a composite of the two types of materials, with ceramic on the inside and metal on the outside. There are a number of conventional techniques for forming protective ceramic coatings on internal surfaces of metal tubes. Among these, a surface chemical reaction has been used to form an oxide film on the inner surfaces of metal tubes, for example, by high-temperature oxidation or low-temperature anodization. Alternatively, thin film deposition techniques, such as physical vapor or chemical vapor depositions, have been used to coat the inside surfaces of the metal tubes with a ceramic material. Thermal-sprayed deposition of ceramic coatings on the inside of the tubes also has been practiced. Additionally, shrink-fitting, i.e., heating up a metal tube followed by telescopically inserting a tubular ceramic shell inside the heated tube, has been known. Also, another technique is to dip the metal tube in a ceramic slurry to provide a ceramic coating on at least the inner surfaces of the tubes. Unfortunately, prior techniques are either expensive or time-consuming approaches for obtaining a uniformly thick ceramic film on the internal surfaces of metal tubes. Furthermore, a more versatile process is needed that not only is applicable to metal tubes, but which also could be practiced on and easily adapted to other types of tubes, such as ceramic tubes.

Sealing and lining techniques for conduits and pipes are also known from the patent literature mentioned below:

U.S. Pat. No. 4,745,879 to Shishkin et al. teaches a device for coating the internal surface of a pipeline which uses hoses, a rotating blade and a smoothing cone. A coating mixture is delivered by a flexible hose to a cone shaped member. The cone shaped member distributes the coating material on the inner surface of the pipeline and serves to smooth out the coating material to form a uniform layer.

U.S. Pat. No. 4,329,937 to Holland teaches a pipe lining apparatus wherein a pipe liner vehicle travels through the pipe applying the material as it moves through. The distributor discharges concrete out of the discharge element onto the inner surface of the pipe as the vehicle traverses in the direction indicated by the arrow. A set of rotating trowel arms smooth the mortar which has been deposited.

U.S. Pat. No. 3,966,389 to Shubert teaches a frusto-conical troweling apparatus for pipe lining. A dispensing head rotates to sling mortar against the interior surface of the pipe. The pipelining machine supplies mortar through a hose, and is pulled from right to left by any suitable means. The conical troweling device moves along with the hose and evens out the mortar on the surface.

U.S. Pat. No. 4,554,178 to Yamamoto et al. teaches a process whereby inorganic oxides are used as sealants to repair and prevent leakage in a pipeline. The sealant contains fine particles of inorganic oxide weakly adhering to one another into aggregations which can enter and plug fine cavities of the interior of a pipeline.

U.S. Pat. No. 4,774,905 to Nobis teaches an apparatus for internally coating pipes. The coating material is drawn through a pipe and fed to the rotating spraying device which atomizes the material and disperses it onto the internal surface of the pipe. The coating material is not specified in the patent.

U.S. Pat. No. 5,443,377 to Perkins et al. teaches a method and apparatus for lining a section of pipe with cement mortar. A section of the water main is lined by delivering wet mortar from a mixer to a lining apparatus, and throwing the wet cement mortar onto the cleaned surface of the water main.

U.S. Pat. No. 5,019,417 to Northcutt teaches a system for pipe lining including a forward seal and a following spreader defining a chamber therebetween for receiving flowable lining material. The spreader is immediately followed by a cylindrical elongate platen formed of radiant-energy transparent material. A radiant energy source is mounted inside the platen which emits radiant energy that is transmitted through the platen to the flowable lining material to effect or accelerate the curing of the lining material.

U.S. Pat. No. 5,326,400 to Sagawa teaches a method for coating an interior surface of an elongated pipe member using a pair of plugs. A first lead plug member has a resilient cylindrical body with an outer diameter close to an inner diameter of the pipe member, and a trailing second plug member has a cylindrical body of an outer diameter smaller than the inner diameter of the pipe member and a brush provided at an end portion of the body of the second plug member, where the brush fiber radially extend outward such that their outer ends define a cylindrical surface having a diameter close to that of the pipe diameter. The coating is applied to the interior surface of the pipe member while the two plug members proceed therethrough.

U.S. Pat. No. 5,499,659 to Naf teaches a process for sealing and internal repair of systems of laid conduits in which a sealant is first applied to the leak by either introducing a sealant into the leaky conduit by means of air, in which the sealant is a dry water-swellable bentonite, a dry hydraulically disintegrated plastic dispersion preparation, or a mixture thereof and then conduit is filled with fluid; or alternatively, the sealant is introduced into the leaky conduit by means of water where the sealant is a finely divided inert material. Next, the conduit is emptied and compressed air charged with abrasive particles is blown through the conduit. Then, the conduit is internally coated by blowing into it a solvent-free epoxy resin containing a hardener and fibers.

SUMMARY OF THE INVENTION

It is therefore an object of the present invention to provide an apparatus and process for uniformly coating thick lining films onto internal surfaces of tubes in an economic manner.

It is another and more specific object of the present invention to provide an apparatus and process for uniformly coating thick ceramic or glass ceramic films on internal surfaces of metal tubes in an economic manner.

The foregoing and other objects are achieved by a tubelining apparatus using a coating-applicator for slip-casting a fluent liner coating onto the internal surface of a tube. A feeding conduit includes a first conduit section which conveys a coating to the top surface of the coating applicator, while a second conduit section of the feeding conduit conveys drying gas to the backside of the applicator to accelerate solidification of the coating film as coated on the internal surface of the tube. A plurality of centering discs are provided at spaced locations along the longitudinal axis of the feeding conduit at locations forward of the coating applicator to precisely position and maintain the tubelining apparatus in the center of the tube being coated. Also, the coating applicator used in this invention will have an edge shape which mimics the particular internal tube cross section to be lined. That is, different geometries of coating applicator shapes are feasible, such as circular or ellipsoidal shapes, depending on the tube wall shape to be lined.

In one preferred embodiment of the process of the present invention, a tube, such as a metal or ceramic tube, has its internal surface lined with a coating derived from a ceramic slurry. The process involves providing a slurry of ceramic powders dispersed in an organic resinous solution, then coating the internal surface of the tube with the slurry using a circular-doctor-blading technique, and drying the coating. The tube bearing the dried coating on its internal surface can then be handled and transported to a separate station for subsequent firing (sintering) of the ceramic film at a later convenient time. In this way, the present invention permits formation of thick yet uniform ceramic coating films on the internal surface of tubes at thicknesses which can even exceed 100 $\mu$m, and generally are formed in a thickness range of 10 to 1,000 $\mu$m, and more specifically in the range of 50 to 250 $\mu$m. The ceramic powders used in the ceramic slurry can be ceramic or glass ceramic powder materials. The ceramic powder materials can be selected, for example, from ceramic materials such as alumina, boric oxide, disodium oxide, magnesium oxide, and silica, either singly or in combinations thereof.

In the case of lining metal tubes, such as steel tubes, pursuant to this invention, the composite tubes produced by the inventive process combine the toughness of metal with the corrosive-, wear-, and heat-resistant properties of ceramics. However, the concepts and equipment of the invention are generally applicable to lining not only metal tubes, but also tubes of other constructions such as ceramic, concrete, and so forth, in which wear prevention and/or tube repair are concerns. Additionally, the invention is applicable to lining either discrete tubes, elongate sections of tubing, or laid tubing or conduit.

For purposes of this application, the terminology "tube" can encompass tubing, pipes, conduits, ducts, and other like structures, through which flowable materials can be conveyed.

BRIEF DESCRIPTION OF THE DRAWINGS

The foregoing and other objects, aspects and advantages will be better understood from the following detailed description of the preferred embodiments of the invention with reference to the drawings, in which.

The drawings are not necessarily to scale, as the thicknesses and other dimensions of the various features are shown for clarity of illustration and should not be interpreted in a limiting sense.

DETAILED DESCRIPTION OF THE PREFERRED EMBODIMENTS OF THE INVENTION

The present invention allows a fluent sealant or liner to be uniformly coated as a thick film onto the internal surface of a tube with rapid drying of the coating provided to stabilize and immobilize the coating until a subsequent firing procedure is performed.

Figure 1:
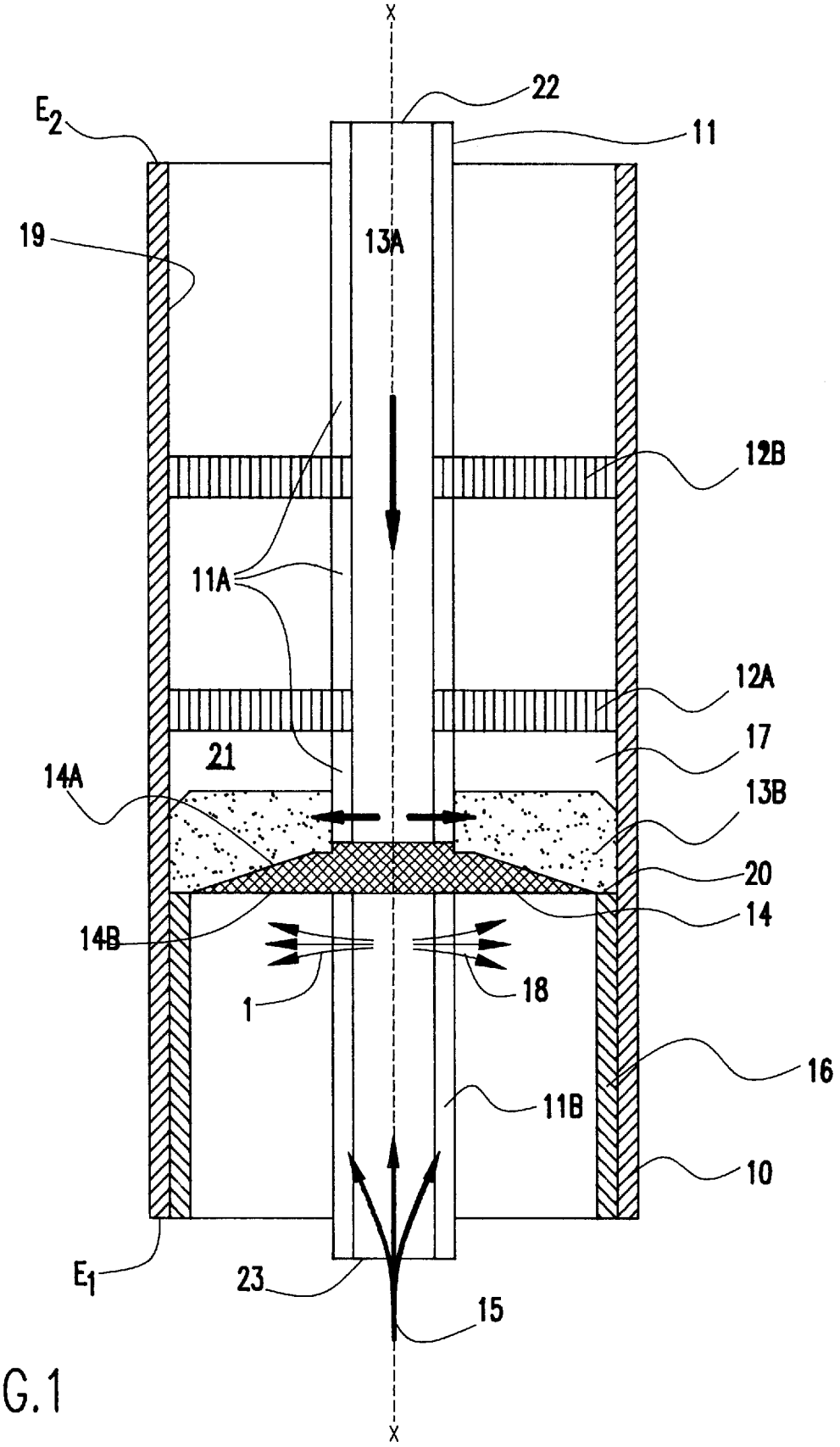
FIG. 1 is a diagrammatic view illustrating the lining of a tube in accordance with the present invention.

Referring now to the drawings, and more particularly to FIG. 1, a metal tube 10 is shown having internal surfaces 19 which is being lined by a process using the tubelining apparatus 1 of this invention.

The tubelining apparatus 1 has been inserted in the metal tube 10 being lined, and it can be translated from one end $e_1$ of the tube 10 to the other end $e_2$ during the coating procedure. Generally, components of the tubelining apparatus 1 include a ceramic slurry and drying gas feeding conduit 11, a coating applicator means 14, and centering spacers 12*a* and 12*b*.

The feeding conduit 11 is divided into a ceramic slurry feeding section 11*a* and a drying gas feeding section 11*b*. The ceramic slurry feeding section 11*a* is located at the leading (forward) side 17 of the coating applicator 14, and it conveys coating slurry 13*a* to the top surface 14*a* of the coating applicator 14. The coating applicator 14 also includes a bottom surface 14*b*. The drying gas feeding section 11*b* is located at the trailing (back) side 18 of the coating applicator 14, and it conveys drying gas 15 to the backside 18 of the applicator 14 where the drying gas 15 is directed onto the coated slurry to accelerate solidification of the coating film 16 applied to the internal surface 19 of the tube 10.

In the practice of this invention, ceramic slurry material 13*a* flows downward through leading conduit section 11*a*, as indicated by an arrow, by effect of gravity if the tube 10/tubelining apparatus 1 system are oriented vertically as in FIG. 1, or therethrough by pumping action if the system is arranged horizontally or some other orientation where gravity alone cannot be used. The conduit section 11*a* terminates near or at the top surface 14*a* of the blade 14. The slurry 13*a* is dispensed out of conduit section 11*a*, as indicated by arrows in FIG. 1, through holes (not shown) provided in conduit section 11*a* near top surface 14*a* of the applicator blade 14 to accumulate as a slurry reservoir 13*b*. The blade 14 drags portions of the ceramic slurry 13*a* from reservoir 13*b* across the internal surface 19 of the tube 10 as the conduit 11 is moved relative to the internal wall 19 of the tube 10 to apply a coating 16 of uniform thickness. The thickness of the coating 16 is dictated by the distance between the internal diameter of the tube 10 and the external diameter of the circular blade 14. On the trailing side 18 of the blade 14, the second conduit section 11*b* carries and then radially dispenses, as indicated by arrows in FIG. 1, a stream of gas 15, such as air, nitrogen, and the like, to dry and set the coated ceramic slurry 13*a* to form solidified (i.e., non-flowable) coating 16. The tube 10 bearing solidified coating (lining) 16 can then be fired to sinter the ceramic coating 16 in a subsequent procedure and at a convenient time.

To cause the tubelining apparatus 1 to traverse the length of the tube 10 to be lined, it is only necessary that at least one of the tubelining apparatus 1 or tube 10 be moved relative to the other. For instance, tube 10 could be immobilized while the tubelining apparatus 1 is pushed or pulled by any convenient means (not shown) through the tube 10, or, alternatively, the tubelining apparatus 1 could be inserted through the tube 10, then immobilized at its ends while the tube 10 is moved parallel to the longitudinal axis x—x of the conduit 11 during coating by a support harness or on a support carriage or the like (not shown). In one preferred scheme, the tubelining apparatus 1 is winched through tube 10 by operation of a conventional winch and winch line (not shown).

Regarding the various individual components of the tubelining apparatus 1 in somewhat more detail, the feeding conduit 11 can be made of any convenient material such as metal, plastic, or ceramic. The drying gas 15 preferably is radially dispensed through openings or holes provided in conduit section 11*b* at a location proximate to the bottom surface 14*b* directly behind the doctor blade 14. The drying gas 15 can be pumped into the conduit section 11*b* from an external supply system (not shown) including conduits and compressor means communicating with the bottom opening 23 of conduit 11. The coating slurry 13*a* is dispensed via holes (not shown) provided in section 11*b* of conduit 11 in the chamber 21 defined as the space between the nearest spacer 12*a* and the top surface 14*a* of the applicator 14. The needed supply of ceramic slurry 13*a* can be poured into the top opening 22 of conduit tube 11, or pumped into conduit section 11*a* from an external supply source system (not shown).

The circular blade 14 is disc-shaped and it serves to both distribute slurry to the internal surface 19 of the tube 10 and to form a coating film of uniform thickness along the internal tube surface 19. The circular, disc-shaped applicator blade 14 can be a circular doctor blade or rigid knife blade. The blade 14 is oriented such that the top surface 14*a* is perpendicular to the longitudinal axis x—x of the tubelining apparatus 1. The coating applicator 14 effectively forms a boundary between the ceramic slurry feeding section 11*a* and the drying gas feeding section 11*b* of conduit 11. The circular applicator blade 14 is axially moved (translated) upward through tube 10 during a tube lining procedure, from the perspective depicted in FIG. 1. The blade 14 should be a nonflexible and preferably of metal construction, such as stainless steel or aluminum.

Figure 2:
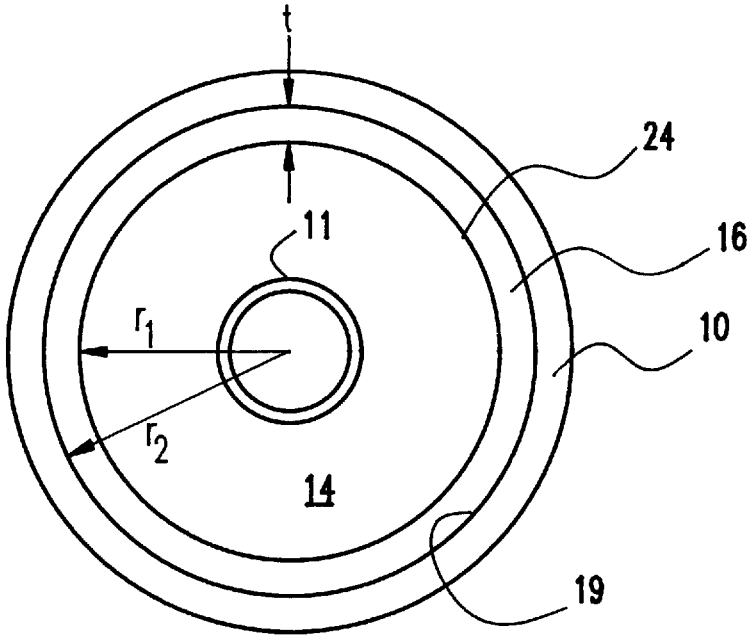
FIG. 2 is an enlarged bottom view of the tubelining apparatus and metal tube combination illustrated in FIG. 1.

As shown in FIG. 2, the radius $r_1$ of the blade 14 is less than the radius $r_2$ of the internal surface 19 of the tube by an amount equal to the desired ceramic slurry (wet) coating thickness "t". The top surface of the blade 14 tapers down towards its outer edge 24 near the internal surface 19 of the tube to encourage continuous coating action at the annular-shaped nip (gap) 20 formed between the blade 14 and internal tube wall 19.

The centering spacers 12*a* and 12*b* are collar-like structures fitted or formed around the feeding conduit 11 in the ceramic slurry feeding section 11*a* thereof. The centering discs 12*a* and 12*b* are provided at spaced locations along the longitudinal axis x—x of the feeding conduit 11 at locations forward of the coating applicator 14 so that they do not disturb the applied coating 16. The centering spacers 12*a* and 12*b* precisely position and maintain the tubelining apparatus 1 in the center of the tube 10 being coated. In the exemplified embodiment, the centering discs 12*a*, 12*b* have a circular outer profile and have an outer diameter that is slightly less in diameter than the diameter of the inner surface 19 of tube 10, e.g., about 50 $\mu$m smaller in diameter. The centering discs 12*a* and 12*b* do not ordinarily engage the internal surface 19 of the metal tube 10 during a coating process of this invention. Instead, the purpose of the centering discs is to prevent conduit 11 from becoming grossly misaligned with the tubewall 19 of tube 10. The centering discs 12*a*, 12*b* are formed of any convenient solid material, such as rubber, metal or ceramic. Also, while a pair of centering discs are illustrated, it will be understood that either one or a plurality (two or more) of such centering discs can be used and the number needed will depend largely on the length of the tube to be lined.

It will be appreciated that this invention is applicable to the lining of tubes of not only metal construction, but also tubes made of ceramic, concrete, or composite materials.

The ceramic slurry 13a used as the coating material generally will involve a ceramic powder filler that has been dispersed in an organic resin solution. The ceramic slurry 13*a* preferably has a pasty consistency and a viscosity of about 2000 centapoise at about 25° C. For example, for lining metal tubes, such as steel tubes, an exemplary coating slurry formulation is an admixture of about 50 parts by weight of cordierite powder, which is a ternary oxide of $MgO/Al_2O_3/SiO_2$ present in a stoichiometric ratio of 2/3/5, respectively; 6 parts by weight polyvinylbutyral (PVB) as the organic resin; 31 parts by weight methyl isobutyl ketone (MIBK); 8 parts ethanol as organic solvent; and 3 parts by weight of butyl benzyl phthalate as plasticizer.

The preferred method for preparing the ceramic slurry 13*a* used as a precursor in forming the coating 16 involves dissolving the organic resin and any plasticizer in the solvent(s), and then dispersing the powdered ceramic filler(s) with mixing into the organic resin solution. This dispersion, or slurry, is then applied to the internal surface 19 of the metal tube 10 with the inventive tubelining apparatus 1. These ingredients can be mixed and coated onto the internal tube surfaces at room temperature (about 25° C.)

Also, a borosilicate glass including silica, alumina, and boric oxide can used as the ceramic powder component in formulation amounts of 48 parts by weight ceramic powder, 6 parts by weight PVB, and 41 parts by weight organic solvent. These slurry formulations have been demonstrated to form tenacious and tough coatings on the internal surfaces of steel tubes.

For coating the internal surface of a ceramic tube, such as $Al_2O_3$ material, the cordierite-based formulation described above also has been demonstrated to work very well in forming a tenacious and tough coating on the internal surface of alumina tubes.

These types of ceramic formulations can be used in the practice of this invention to provide a superior combination of coating properties, such as strong adhesion to the metal, uniform thickness, high density with controllable porosity content, tough, high thermal shock resistance, adjustable thermal expansion coefficient and conductivity, and strong corrosion and wear resistance.

As explained above, the drying gas 15 is used to set and cure (solidify) the ceramic coating after it is film-coated onto the internal walls of the tube. The drying gas 15 can be air, nitrogen or any other gas that is chemically inert to the components of the coating slurry composition 13*a*. The drying gas generally need not be heated to effect solidification of ceramic slurry compositions in most cases where the viscosity of the ceramic slurry is appropriately managed. However, the drying gas could be heated, if necessary, such as where the viscosity of the ceramic slurry is relatively low upon film coating.

Other modes and variations of the present invention besides those exemplified in detail herein are also contemplated. For instance, while FIG. 1 illustrates lining a tube 10 in a vertical orientation during the coating procedure of the present invention, it will be understood that the orientation of the tube 10 is not particularly limited and that the coating/lining process of this invention can be practiced on a tube in any orientation as long as sufficient access is provided at the opposite ends of the tube to permit insertion of the tubelining apparatus of this invention. When the tube is vertically oriented, the ceramic slurry reservoir 13*b* does not need to completely fill the chamber 17 as long as the amount of accumulated slurry 13*b* is adequate to coat the entire internal circumference of the tube 10. However, if the metal tube to be lined is oriented horizontally, for example, then chamber 17 defined between the front surface 14*a* of doctoring blade 14 and the closest centering collar 12*a* should be completely filled with the ceramic slurry to ensure that the entire circumference of the internal surface 19 of the tube has slurry applied thereto at nip 20. Also, even though sagging of the coating is less of a concern in the vertical orientation, it is thought that potential sagging problems can be dealt with even in non-vertical orientations by appropriate adjustment of the consistency and viscosity of the slurry 13*a*.

Figure 3:
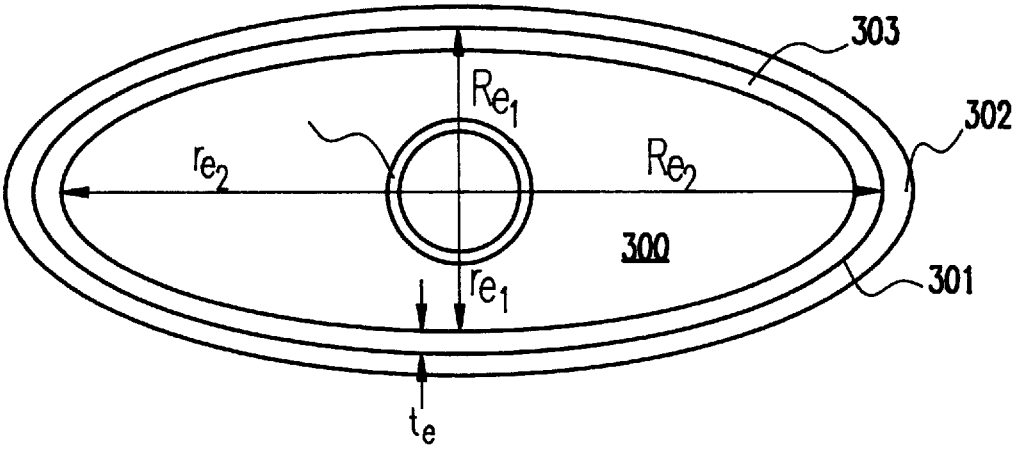
FIG. 3 is an enlarged bottom view of an alternate embodiment of the invention in which an ellipsoidal-shaped tube is lined by a tubelining apparatus of the invention.

Additionally, although the lining of a tube having an internal surface presenting a circular cross section has been exemplified in detail, which will often be the case, it will be understood that the tubelining concepts and principles of this invention can also be applied to tubes and conduits with other inner cross sections, such as ellipsoidal, square, rectangular, rhombic, and so forth, cross sections. For instance, in the alternate case of an ellipsoidal shaped tube wall, as shown in FIG. 3, the coating applicator blade means 300, is provided with an ellipsoidal outer edge profile having a major radius value $r_{e1}$ and minor radius value $r_{e2}$ that each are less than the corresponding major and minor radii $R_{e1}$ and $R_{e2}$ of the ellipsoidal-shaped internal surface 301 of the tube 302 by an amount equal to the uniform (wet) coating thickness "$t_e$" of ceramic slurry 303. Conduit 11 is the same as defined supra. Also in the case of an ellipsoid shaped tube wall and applicator slurry blade, the centering discs would be reconfigured to have an ellipsoidal shape with diameters slightly less than the corresponding internal diameters of the tube, or as a circular shape with a radius slightly less than the smaller radius of the internal tube wall.

Also, this invention can be practiced on discrete tube sections, elongated sections of a tube, or even laid tubes or pipes. If practiced on very long sections of tubing or laid pipes which cannot be fired in a furnace or oven, etc., a conventional pipe pig could be run through the lined tube or pipe with a heating means attached thereto, such as radiant heaters, flame throwers, or hot gas blowers, in order to effect sintering of the ceramic coating.

While the invention has been described in terms of its preferred embodiments, those skilled in the art will recognize that the invention can be practiced with modification within the spirit and scope of the appended claims.

What is claimed:

1. A tubelining apparatus using a coating applicator for slip-casting a fluent liner coating onto the internal surface of a tube, comprising:

a feeding conduit having a first section and a second section longitudinally extending from the first section, the first section having means for conveying and applying coating film to the internal surface of the tube and the second section conveying drying gas to the internal surface of the tube to accelerate solidification of the coating film coated on the internal surface of the tube; and at least one centering disc being provided at a location along a longitudinal axis of the feeding conduit and proximate to the first section and spaced away from the second section, the at least one centering disc being movable with relation to the internal surface of the tube during application of the coating film while precisely positioning and maintaining the tubelining apparatus in the center of the tube being coated, the at least one centering disc having an outer diameter smaller than an inner diameter of the tube.

2. A tubelining apparatus for internally coating a tube, comprising:

a feeding conduit insertable into a tube having an internal tube surface to be lined, the feeding conduit including a leading conduit section and a trailing conduit section longitudinally extending from the leading conduit section, the leading conduit section transporting fluent coating material and the trailing conduit section transporting coating-drying gas;

a coating applicator oriented perpendicular to the longitudinal axis of the feeding conduit, the coating applicator being provided at a juncture of the leading conduit section and the trailing conduit section, the coating applicator having a top surface retaining fluent coating material supplied through the leading conduit section, the coating applicator further having peripheral edges forming an annular nip with the internal tube surface where application of the coating upon the internal tube surface occurs;

means for supplying drying gas through the trailing conduit section, the gas drying the coating after application of the coating to the internal tube surface, the means for supplying drying gas disposed proximate to the trailing conduit section; and a first centering disc and a second centering disc supported on the leading conduit section of the feeding conduit, the first and second centering discs being spaced apart from each other along the longitudinal axis of the feeding conduit, the first and second centering discs having an outer diameter smaller than an inner diameter of the tube so that the first and second centering discs do not substantially engage the internal surface of the tube during coating, wherein one of the first and second centering discs and the coating applicator define a chamber therebetween that receives and accumulates fluent coating material from the leading conduit section.

3. The tubelining apparatus of claim 2, wherein the coating applicator has a peripheral edge shape selected from the group consisting of circular and ellipsoidal.

4. The tubelining apparatus of claim 2, wherein the internal tube surface has a circular cross sectional shape and said coating applicator has a circular peripheral edge shape.

5. The tubelining apparatus of claim 2, wherein the coating applicator is a circular doctor blade.

6. The tubelining apparatus of claim 5, wherein the circular doctor blade is a metal disc with a tapered top surface.

* * * * *